US009618237B2

(12) United States Patent
Kim et al.

(10) Patent No.: US 9,618,237 B2
(45) Date of Patent: Apr. 11, 2017

(54) AIR CONDITIONER AND METHOD FOR CONTROLLING THE SAME

(71) Applicant: LG Electronics Inc., Seoul (KR)

(72) Inventors: Byeongsu Kim, Seoul (KR); Beomchan Kim, Seoul (KR); Younghwan Ko, Seoul (KR); Byoungjin Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 368 days.

(21) Appl. No.: 14/248,009

(22) Filed: Apr. 8, 2014

(65) Prior Publication Data

US 2014/0305144 A1 Oct. 16, 2014

(30) Foreign Application Priority Data

Apr. 15, 2013 (KR) ..... 10-2013-0041157

(51) Int. Cl.
*F25B 13/00* (2006.01)
*F25B 1/10* (2006.01)
(Continued)

(52) U.S. Cl.
CPC ..... *F25B 13/00* (2013.01); *F25B 1/10* (2013.01); *F25B 41/04* (2013.01); *F25B 43/006* (2013.01);
(Continued)

(58) Field of Classification Search
CPC ..... F25B 41/04; F25B 43/006; F25B 1/10; F25B 2313/0314; F25B 2600/2509; F25B 2313/005; F25B 2400/13; F25B 2313/0292
See application file for complete search history.

(56) References Cited

U.S. PATENT DOCUMENTS 5,934,094 A * 8/1999 Itoh ..... B60H 1/3205 62/160
5,996,364 A * 12/1999 Lifson ..... F04C 28/24 62/196.1
(Continued)

FOREIGN PATENT DOCUMENTS

DE 102007058969 A1 6/2008
EP 1647783 A2 4/2006
(Continued)

*Primary Examiner* — Allana Lewin Bidder
*Assistant Examiner* — Kun Kai Ma
(74) *Attorney, Agent, or Firm* — Dentons US LLP

(57) ABSTRACT

An air conditioner includes a compressor, an outdoor heat exchanger, an indoor heat exchanger, a converting unit, an accumulator, and injection module, a supercooling valve, and an injection valve. The injection module expands and vaporizes a portion of refrigerant flowing from the indoor heat exchanger to the outdoor heat exchanger in the heating operation. The supercooling valve is disposed between the injection module and the accumulator and is opened to direct the portion of the refrigerant vaporized in the injection module to the accumulator in the heating operation and then closed after a predetermined time passes. The injection valve is disposed between the injection module and the compressor and is opened when the supercooling valve is closed in the heating operation, thereby injecting the portion of the refrigerant vaporized in the injection module to the compressor.

12 Claims, 5 Drawing Sheets

(51) Int. Cl.
*F25B 41/04* (2006.01)
*F25B 43/00* (2006.01)

(52) U.S. Cl.
CPC . *F25B 2313/005* (2013.01); *F25B 2313/0292* (2013.01); *F25B 2313/02741* (2013.01); *F25B 2313/0314* (2013.01); *F25B 2313/0315* (2013.01); *F25B 2400/13* (2013.01); *F25B 2600/2509* (2013.01); *F25B 2700/21152* (2013.01)

(56) References Cited

U.S. PATENT DOCUMENTS 7,997,092 B2 * 8/2011 Lifson ..... F25B 41/04 62/115
8,069,683 B2 * 12/2011 Lifson ..... F25B 49/022 62/196.3
8,528,359 B2 * 9/2013 Lifson ..... F25B 9/008 62/113
2005/0235689 A1 * 10/2005 Lifson ..... F25B 49/02 62/513
2006/0080989 A1 * 4/2006 Aoki ..... F25B 40/00 62/324.4
2008/0229782 A1 * 9/2008 Takegami ..... F25B 7/00 62/513
2009/0199581 A1 * 8/2009 Ushijima ..... F25B 30/02 62/238.7
2009/0241569 A1 * 10/2009 Okada ..... F25B 40/00 62/196.1
2010/0205988 A1 * 8/2010 Jiang ..... F25B 1/10 62/225
2011/0113804 A1 * 5/2011 Chin ..... F25B 1/04 62/222
2011/0113808 A1 * 5/2011 Ko ..... F25B 1/04 62/324.3
2012/0111050 A1 * 5/2012 Jang ..... F25B 13/00 62/510
2012/0125024 A1 * 5/2012 Ryu ..... F25B 40/02 62/115
2013/0000340 A1 * 1/2013 Takayama ..... F25B 9/008 62/222
2014/0053587 A1 * 2/2014 Arii ..... F25B 41/043 62/196.1
2014/0238067 A1 * 8/2014 Itou ..... F25B 41/04 62/324.6
2015/0052925 A1 * 2/2015 Hata ..... F25B 49/022 62/228.3
2015/0316284 A1 * 11/2015 Tanaka ..... F25B 13/00 62/196.1

FOREIGN PATENT DOCUMENTS

EP 2535674 A2 12/2012
EP 2660962 A2 11/2013
JP 2008-138921 6/2008
JP 4812606 B2 9/2011
WO 2012098582 A1 7/2012

* cited by examiner

AIR CONDITIONER AND METHOD FOR CONTROLLING THE SAME

This application claims priority of Korean Application No. 10-2013-0041157 filed on Apr. 15, 2013, which is incorporated by reference as if fully set forth herein.

BACKGROUND

1. Field of the Disclosure

The present disclosure relates to an air conditioner and a method for controlling the air conditioner, and more particularly, to an air conditioner that is designed to stably inject refrigerant to a compressor and a method for controlling the air conditioner.

2. Description of the Related Art

Generally, an air conditioner is a system that keeps air cool and warm using a refrigeration cycle including an outdoor heat exchanger, an expansion valve, and an indoor heat exchanger. That is, the air conditioner may be designed to have a cooling device for keeping indoor air cool and a heating device for keeping indoor air warm. Alternatively, the air conditioner may be designed to have a device with both cooling and heating functions.

When the air conditioner is designed to have the device with both the cooling and heating functions, the air conditioner includes a converting unit for converting a flow passage of refrigerant compressed by a compressor in accordance with an operational condition (i.e., a cooling operation and a heating operation). That is, in the cooling operation, refrigerant compressed by the compressor is directed to the outdoor heat exchanger through the converting unit. At this point, the outdoor heat exchanger functions as a condenser. Refrigerant condensed by the outdoor heat exchanger expands in an expansion valve and is introduced into the indoor heat exchanger. At this point, the indoor heat exchanger functions as a vaporizer. Refrigerant vaporized by the indoor heat exchanger is redirected into the compressor through the converting unit.

The air conditioner improves its efficiency by injecting a portion of refrigerant condensed in the heating or cooling operation into the compressor.

SUMMARY

Thus, one object is to provide an air conditioner that is designed to stably inject refrigerant to a compressor and a method for controlling the air conditioner.

Other objects will be clearly understood by the persons skilled in the art from the following description.

According to one aspect, there is provided an air conditioner including: a compressor for compressing refrigerant; an outdoor heat exchanger disposed outdoors and allowing refrigerant to heat-exchange with outdoor air; an indoor heat exchanger disposed indoors and allowing refrigerant to heat-exchange with indoor air; a converting unit for directing refrigerant discharged from the compressor to the outdoor heat exchanger in the cooling operation and to the indoor heat exchanger in the heating operation; an accumulator disposed between the converting unit and the compressor to separate gas-phase and liquid phase refrigerants; an injection module for expanding and vaporizing a portion of refrigerant flowing from the indoor heat exchanger to the outdoor heat exchanger in the heating operation; a supercooling valve disposed between the injection module and the accumulator and opened to direct refrigerant vaporized in the injection module to the accumulator in the heating operation and then closed after a predetermined time passes; and an injection valve disposed between the injection module and the compressor and opened when the supercooling valve is closed in the heating operation, thereby injecting refrigerant vaporized in the injection module to the compressor.

According to another aspect, there is provided a method of controlling an air conditioner including: directing, by a converting unit, refrigerant discharged from a compressor to an indoor heat exchanger at a start of the heating operation; expanding and vaporizing a portion of the refrigerant by an injection module flowing from the indoor heat exchanger to an outdoor heat exchanger; opening a supercooling valve by a controller to direct the portion of the refrigerant vaporized by the injection module to an accumulator through the supercooling valve; determining by the controller whether a predetermined time had passed; closing the supercooling valve by the controller if the controller determines that the predetermined time had passed; and opening an injection valve by the controller to direct the portion of the refrigerant vaporized by the injection module to the compressor through the injection valve.

The foregoing and other objects, features, aspects and advantages will become more apparent from the following detailed description when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the invention and together with the description serve to explain the principles of the invention.

In the drawings.

DETAILED DESCRIPTION OF THE EMBODIMENT

Figure 1:
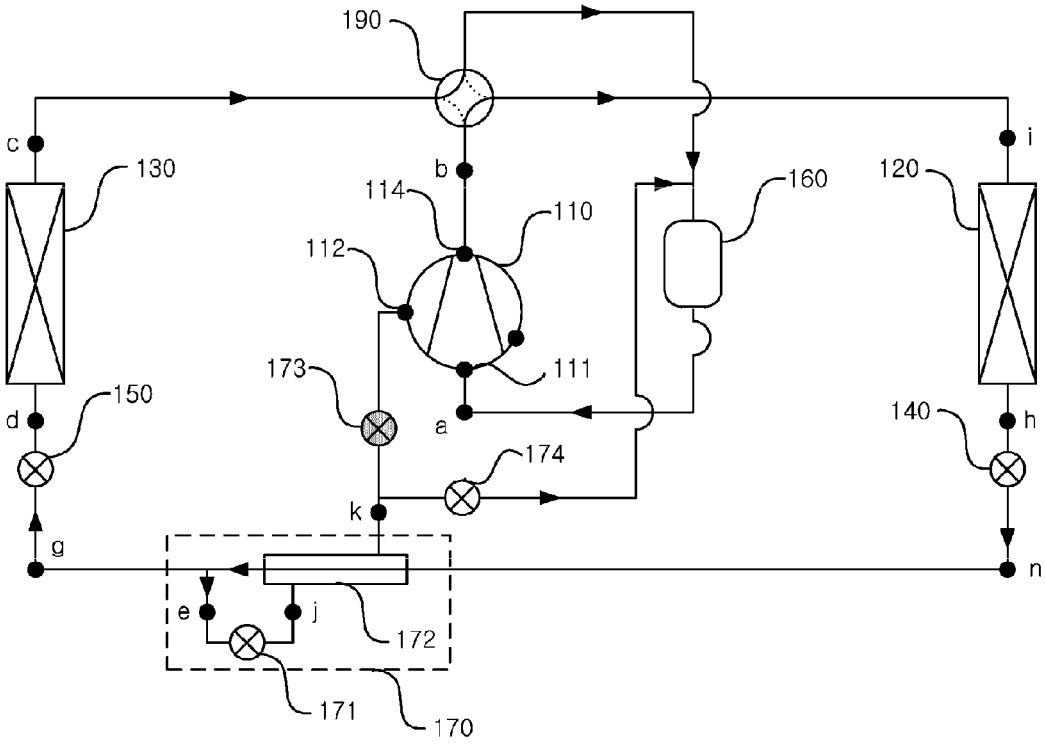
FIG. 1 is a schematic view illustrating a refrigerant flow in a cooling operation of an air conditioner according to an exemplary embodiment of the present invention.

The foregoing and other objects, features, aspects and advantages will become more apparent from the following detailed description when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the principles of the invention to those skilled in the art. In the drawings, the shapes and dimensions may be exaggerated for clarity, and the same reference numerals will be used throughout to designate the same or like components.

Hereinafter, exemplary embodiments of the present invention will be described in detail with reference to the accompanying drawings.

FIG. 1 is a schematic view illustrating a refrigerant flow in a cooling operation of an air conditioner according to an exemplary embodiment of the present invention.

An air conditioner of an exemplary embodiment of the present invention includes a compressor 110 for compressing refrigerant, an outdoor heat exchanger 120 that is installed out of a room for heat-exchange between outdoor air and refrigerant, an indoor heat exchanger 130 that is installed in the room for heat-exchange between indoor air and refrigerant, a converting unit 190 for directing refrigerant from the compressor 110 to the outdoor heat exchanger 120 in an cooling operation and directing refrigerant from the compressor 110 to the indoor heat exchanger 130 in a heating operation, an injection module 170 for expanding and vaporizing a portion of refrigerant flowing from the outdoor heat exchanger 120 to the indoor heat exchanger 130, a supercooling valve 174 for directing, when it is opened, refrigerant vaporized by the injection module 170 to an accumulator 160, and an injection valve 173 for, when it is opened, injecting refrigerant vaporized by the injection module 170 to the compressor 110.

The compressor 110 compresses refrigerant introduced from a low-pressure low-temperature state to a high-pressure high-temperature state. The compressor 110 may be formed in a variety of structures. That is, the compressor 110 may be a reciprocating compressor using a cylinder and a piston or a scroll compressor using an orbiting scroll and a fixed scroll. In this exemplary embodiment, the compressor 110 is the scroll compressor. In one embodiment, a plurality of compressors may be provided.

The compressor 110 includes an inlet port 111 through which refrigerant vaporized in the indoor heat exchanger 130 is introduced in the cooling operation or refrigerant vaporized in the outdoor heat exchanger 120 is introduced in the heating operation, an injection port 112 through which refrigerant that expands and is vaporized in the injection module 170 is introduced, and an outlet port 114 through which the compressed refrigerant is discharged.

Refrigerant introduced through the inlet port 111 has pressure and temperature that are lower than those of refrigerant introduced through the injection port 112. Refrigerant introduced into the injection port 112 has pressure and temperature that are lower than those of refrigerant discharged through the outlet port 114.

The compressor 110 compresses refrigerant introduced through the inlet port 111 in a compressing chamber. Refrigerant introduced through the inlet port 111 and refrigerant introduced through the injection port 112 are mixed with each other and compressed by the compressor 110, after which it is discharged through the outlet port 114.

The accumulator 160 separates a gas-phase refrigerant and a liquid-phase refrigerant from refrigerant vaporized in the indoor heat exchanger 130 in the cooling operation or refrigerant vaporized in the outdoor heat exchanger 120 in the heating operation. The accumulator 160 is provided between the converting unit 190 and the inlet port 111 of the compressor 110. The gas-phase refrigerant separated in the accumulator 160 is introduced into the compressor 110 through the inlet port 111.

The converting unit 190 is a flow passage converting valve for cooling-heating conversion. The converting unit 190 directs refrigerant compressed in the compressor 110 to the outdoor heat exchanger 120 in the cooling operation and to the indoor heat exchanger 130 in the heating operation. In one embodiment, the converting unit 190 may be formed of a variety of valves or a combination thereof that can convert for four flow passages.

The converting unit 190 is connected to the outlet port 114 of the compressor 110 and the accumulator 160, and is further connected to the indoor and outdoor heat exchangers 130 and 120. In the cooling operation, the converting unit 190 connects the outlet port 114 of the compressor 110 to the outdoor heat exchanger 120 and further connects the indoor heat exchanger 130 to the accumulator 160. In the heating operation, the converting unit 190 connects the outlet port 114 of the compressor 110 to the indoor heat exchanger 130 and further connects the outdoor heat exchanger 120 to the accumulator 160.

The converting unit 190 may be formed in a variety of different modules that can connect different passages to each other. In this exemplary embodiment, a four-way valve may be used for the converting unit 190. However, the present invention is not limited to this exemplary embodiment. A combination of two 3-way valves or other valves may be used as the converting unit.

The outdoor heat exchanger 120 may be disposed out of the room. Refrigerant heat-exchanges with the outdoor air while passing through the outdoor heat exchanger 120. The outdoor heat exchanger 120 functions as a condenser for condensing refrigerant in the cooling operation and as a vaporizer for vaporizing refrigerant in the heating operation.

The outdoor heat exchanger 120 is connected to the converting unit 190 and the outdoor expansion valve 140. In the cooling operation, refrigerant compressed in the compressor 110 and passing through the outlet port 114 of the compressor 110 and the converting unit 190 is introduced into the outdoor heat exchanger 120 and condensed, after which refrigerant is directed to the outdoor expansion valve 140. In the heating operation, refrigerant expanding in the outdoor expansion valve 140 is introduced into the indoor heat exchanger 120 and vaporized and discharged to the converting unit 190.

The outdoor expansion valve 140 is completely opened in the cooling operation to allow refrigerant to pass. In the heating operation, the opening degree of the indoor expansion valve 140 is adjusted to expand refrigerant. The outdoor expansion valve 140 is connected to the outdoor heat exchanger 120 and the injection module 170. The outdoor expansion valve 140 is provided between the outdoor heat exchanger 120 and the injection module 170.

The outdoor expansion valve 140 directs refrigerant introduced from the outdoor heat exchanger 120 to the injection module 170 in the cooling operation. The outdoor expansion valve 140 expands refrigerant flowing from the injection module 170 to the outdoor heat exchanger 120 in the heating operation.

The indoor heat exchanger 130 is disposed in the room to allow refrigerant passing through the indoor heat exchanger 130 to heat-exchange with the indoor air. In the cooling operation, the indoor heat exchanger 130 functions as a vaporizer for vaporizing refrigerant. In the heating operation, the indoor heat exchanger 130 functions as a condenser for condensing refrigerant.

The indoor heat exchanger 130 is connected to the converting unit 190 and the indoor expansion valve 150. In the cooling operation, refrigerant expanding in the indoor expansion valve 150 is directed into the indoor heat exchanger 130 and vaporized and discharged to the converting unit 190. In the heating operation, refrigerant that is compressed in the compressor 110 and passes through the outlet port 114 of the compressor 110 and the converting unit 190 is introduced into the heat exchanger 130 and condensed and directed to the indoor expansion valve 150.

In the cooling operation, the opening degree of the indoor expansion valve 150 is adjusted to expand refrigerant. In the heating operation, the indoor expansion valve 150 is completely opened to allow refrigerant to pass therethrough. The indoor expansion valve 150 is connected to the indoor heat exchanger 130 and the injection module 170 and disposed between the indoor heat exchanger 130 and the injection module 170.

In the cooling operation, the indoor expansion valve 150 expands refrigerant flowing from the injection module 170 to the indoor heat exchanger 130. In the heating operation, the indoor expansion valve 150 directs refrigerant from the indoor heat exchanger 130 to the injection module 170.

In the cooling operation, the injection module 170 supercools refrigerant. In the heating operation, the injection module 170 supercools refrigerant or injects a portion of refrigerant to the compressor 110. In one embodiment, the injection module 170 may inject a portion of refrigerant to the compressor 110 in the cooling operation. The injection module 170 is connected to the indoor expansion valve 150, the injection valve 173, the supercooling valve 174, and the outdoor expansion valve 140.

In the cooling operation, the injection module 170 expands and vaporizes a portion of refrigerant coming from the outdoor heat exchanger 120. In addition, the injection module 170 supercools refrigerant coming from the outdoor heat exchanger 120 and directs refrigerant to the indoor expansion valve 150.

In the heating operation, the injection module 170 expands and vaporizes a portion of refrigerant coming from the indoor heat exchanger 130. In addition, the injection module 170 supercools the rest of refrigerant coming from the indoor heat exchanger 130 and directs refrigerant to the outdoor expansion valve 140.

The injection module 170 includes an injection expansion valve 171 for expanding a portion of refrigerant passing therethrough and an injection heat exchanger 172 supercools the rest of refrigerant passing therethrough by heat-exchanging with refrigerant expanded in the injection expansion valve 171.

The injection expansion valve 171 is connected to the indoor expansion valve 150 and the injection heat exchanger 172. The injection expansion valve 171 expands refrigerant flowing from the injection heat exchanger 172 to the accumulator 160 in the cooling operation. The injection expansion valve 171 expands refrigerant injected from the indoor heat exchanger 130 to the accumulator 160 or the compressor 110 in the heating operation.

In the cooling operation, the injection expansion valve 171 expands a portion of refrigerant that passes through the injection heat exchanger 172 via the outdoor heat exchanger 120 and the outdoor expansion valve 140 and directs the expanding refrigerant to the injection heat exchanger 172. In the heating operation, the injection expansion valve 171 expands a portion of refrigerant coming from the indoor heat exchanger 130 via the indoor expansion valve 150 and directs the same to the injection heat exchanger 172.

The injection heat exchanger 172 is connected to the indoor expansion valve 150, the injection expansion valve 171, the outdoor expansion valve 140, the injection valve 173, and the supercooling valve 174.

In the cooling operation, the injection heat exchanger 172 allows refrigerant, which comes from the outdoor heat exchanger 120 via the outdoor expansion valve 140, to heat-exchange with refrigerant expanded in the injection expansion valve 171. In the heating operation, the injection heat exchanger 172 allows refrigerant, which comes from the indoor heat exchanger 130 via the indoor expansion valve 150, to heat-exchange with refrigerant expanded in the injection expansion valve 171.

In the cooling operation, the injection heat exchanger 172 allows refrigerant coming from the outdoor heat exchanger 120 to heat-exchange with refrigerant expanded in the injection expansion valve 171. In the cooling operation, refrigerant supercooled in the injection heat exchanger 172 is directed to the indoor expansion valve 150 and vaporized and further directed to the accumulator 160 via the supercooling valve 174.

In the heating operation, the injection heat exchanger 172 allows a portion of refrigerant coming from the indoor heat exchanger 130 to heat-exchange with refrigerant expanded in the injection expansion valve 171. In the heating operation, refrigerant supercooled in the injection heat exchanger 172 is directed to the outdoor expansion valve 140 and vaporized and directed to the accumulator 160 via the supercooling valve 174 or injected to the injection port 112 of the compressor 110 via the injection valve 173.

The supercooling valve 174 is disposed between the injection heat exchanger 172 of the injection module 170 and the accumulator 160. In the cooling operation, the supercooling valve 174 is opened and directs refrigerant expanded in the injection expansion valve 171 and vaporized in the injection heat exchanger 172 to the accumulator 160. Refrigerant directed to the accumulator 160 is mixed with refrigerant heat-exchanging in the indoor heat exchanger 130. In the heating operation, the supercooling valve 174 is opened when the injection condition is satisfied so as to direct refrigerant vaporized in the injection heat exchanger 172 to the accumulator 160 and is then closed after a predetermined time passed.

The injection valve 173 is disposed between the injection heat exchanger 172 of the injection module 170 and the injection port 112 of the compressor 110. In the cooling operation, the injection valve 173 is closed. The injection valve 173, in the heating operation, is opened when the supercooling valve 174 is closed so as to direct refrigerant expanded in the injection expansion valve 171 and vaporized in the injection heat exchanger 172 to the injection port 112 of the compressor 110.

The operation of the supercooling valve 174 and the injection valve 173 in the heating operation will be described with reference to FIGS. 3 to 5 later.

Hereinafter, a cooling operation of an air conditioner according to an exemplary embodiment of the present invention will be described.

Refrigerant compressed in the compressor 110 is discharged through the outlet port 114 and directed to the converting unit 190. In the cooling operation, the converting unit 190 connects the outlet port 114 of the compressor 110 to the outdoor heat exchanger 120 and thus, refrigerant directed to the converting unit 190 is directed to the outdoor heat exchanger 120.

Refrigerant directed from the converting unit 190 to the outdoor heat exchanger 120 heat-exchanges with the outdoor air and thus, is condensed. Refrigerant condensed in the outdoor heat exchanger 120 is transferred to the outdoor expansion valve 140. In the cooling operation, the outdoor expansion valve 140 is fully opened and thus, refrigerant passes through the outdoor expansion valve 140 and is then directed to the injection module 170.

Refrigerant transferred to the injection module 170 is supercooled in the injection heat exchanger 172. A portion of refrigerant supercooled in the injection heat exchanger 172 is directed to the injection expansion valve 171. Refrigerant expanded in the injection expansion valve 171 heat-exchanges with refrigerant flowing from the injection heat exchanger 172 to the outdoor heat exchanger 120 and is vaporized.

In the cooling operation, the injection valve 173 is closed and the supercooling valve 174 is open. Therefore, refrigerant vaporized in the injection heat exchanger 172 is transferred to the supercooling valve 174. Refrigerant passing through the supercooling valve 174 is directed to the accumulator 160 and mixed with refrigerant vaporized in the indoor heat exchanger 130

A portion of refrigerant supercooled in the injection heat exchanger 172 is directed to the indoor expansion valve 150. Refrigerant expanded in the indoor expansion valve 150 is transferred to the indoor heat exchanger 130. Refrigerant directed to the indoor heat exchanger 130 is vaporized by heat-exchanging with the indoor air. The vaporized refrigerant is transferred to the converting unit 190.

Since the converting unit 190 connects the indoor heat exchanger 130 to the accumulator 160 in the cooling operation, refrigerant directed from the indoor heat exchanger 130 to the converting unit 190 is transferred to the accumulator 160. Refrigerant transferred to the accumulator 160 is mixed with refrigerant coming from the supercooling valve 174. The gas-phase and liquid-phase refrigerants are separated from the mixed refrigerant. The gas-phase refrigerant separated in the accumulator 160 is introduced into the compressor 110 through the inlet port 111 and compressed and discharged through the outlet port 114.

Figure 2:
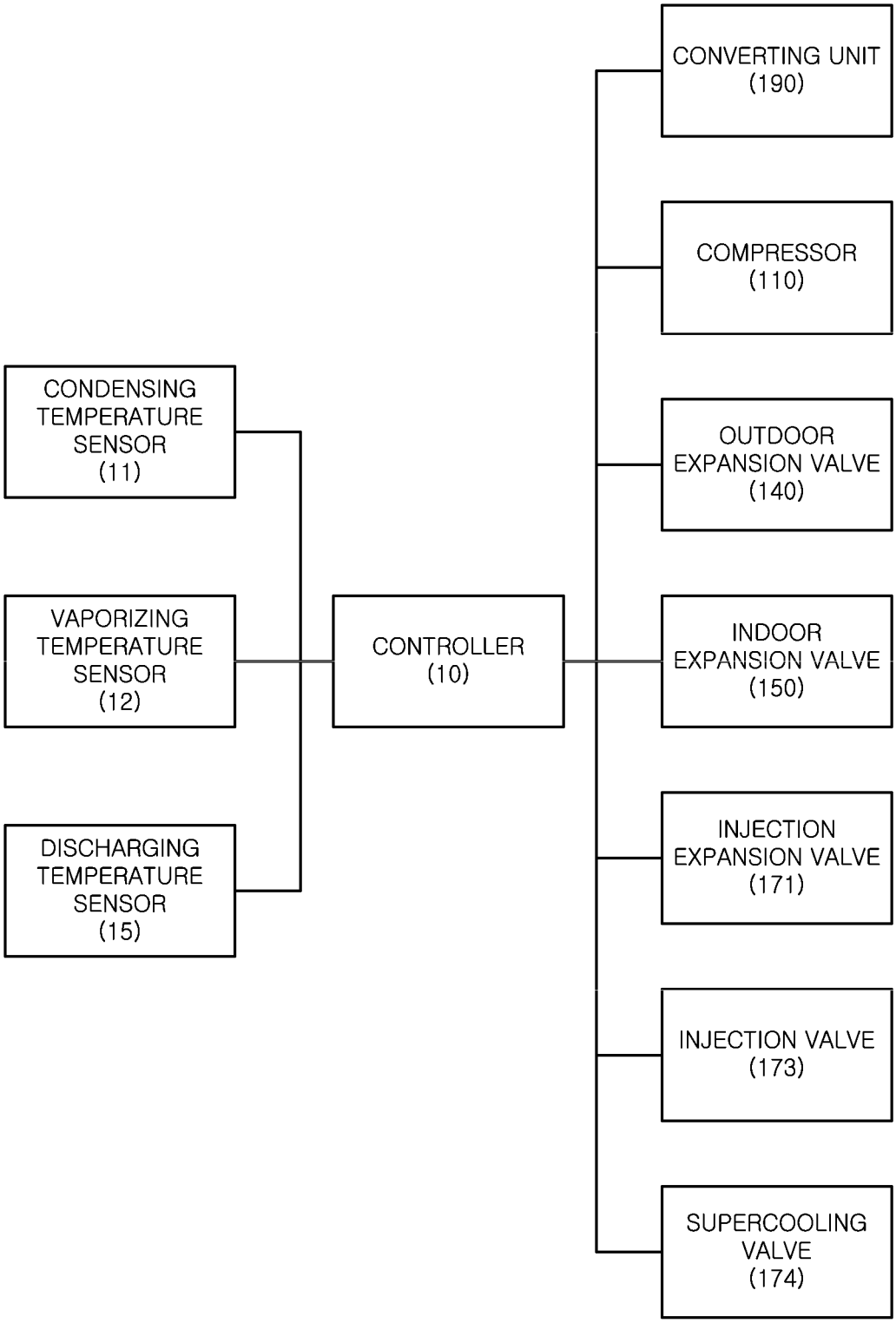
FIG. 2 is a block diagram of an air conditioner according to an exemplary embodiment of the present invention.

FIG. 2 is a block diagram of the air conditioner according to an exemplary embodiment of the present invention.

Referring to FIG. 2, the air conditioner according to an exemplary embodiment of the present invention includes a controller 10 for controlling the air conditioner, a condensing temperature sensor 11 for measuring a condensing temperature of refrigerant, and a vaporizing temperature sensor 12 for measuring a vaporizing temperature of refrigerant, and a discharging temperature sensor 15 for measuring a discharging temperature of refrigerant discharged from the compressor 110.

The controller 10 controls the operation of the air conditioner by controlling the converting unit 190, the compressor 110, the outdoor expansion valve 140, the indoor expansion valve 150, the injection expansion valve 171, the injection valve 173, and the supercooling valve 174.

The controller 10 selects the cooling and heating operations by controlling the converting unit 190. The controller 10 controls the operating speed of the compressor 110 according to a load. The controller 10 adjusts the opening degree of the outdoor expansion valve 140 in the heating operation and opens the outdoor expansion valve 140 in the cooling operation. The controller 10 opens the indoor expansion valve 150 in the heating operation and adjusts the opening degree of the indoor expansion valve 150 in the cooling operation. The controller 10 adjusts the opening degree of the injection expansion valve 171 or closes the injection expansion valve.

The controller 10 opens the supercooling valve 174 and closes the injection valve 173 in the cooling operation. The controller 10 opens the supercooling valve 174 in the cooling operation when the injection condition is satisfied and closes the same after a predetermined time passes, after which the controller 10 opens the injection valve 173. The operation of the supercooling valve 174 and the injection valve 173 in the heating operation will be described with reference to FIGS. 3 to 5 later.

The condensing temperature sensor 11 measures the condensing temperature of refrigerant in the indoor heat exchanger 130 in the heating operation, and measures the condensing temperature of refrigerant in the outdoor heat exchanger 120 in the cooling operation. The condensing temperature sensor 11 is located at a variety of locations to measure the condensing temperature of refrigerant. In this exemplary embodiment, the condensing temperature sensor 11 is provided at a "d" location in the heating operation and at an "h" location in the cooling operation. In one embodiment, the condensing temperature sensor 11 may be provided on the indoor heat exchanger 130 in the heating operation, and may be provided on the outdoor heat exchanger 120 in the cooling operation.

In one embodiment, the condensing temperature of refrigerant may be calculated by measuring the pressure of refrigerant passing through the indoor heat exchanger 130 in the heating operation and may be calculated by measuring the pressure of refrigerant passing through the outdoor heat exchanger 120 in the cooling operation.

The vaporizing temperature sensor 12 measures the vaporizing temperature of refrigerant in the outdoor heat exchanger 120 in the heating operation, and measures the vaporizing temperature of refrigerant in the indoor heat exchanger 130 in the cooling operation. The vaporizing temperature sensor 12 may measure the vaporizing temperature by being located at a variety of locations. In this exemplary embodiment, the vaporizing temperature sensor 12 is provided at an "i" location in the heating operation and at a "c" location in the cooling operation. In one embodiment, the vaporizing temperature sensor 12 is provided on the outdoor heat exchanger in the hating operation and at the indoor heat exchanger in the cooling operation.

In one embodiment, the vaporizing temperature of refrigerant may be calculated by measuring the pressure of refrigerant passing through the outdoor heat exchanger 120 in the heating operation and calculated by measuring the pressure of refrigerant passing through the indoor heat exchanger 130 in the cooling operation.

The discharging temperature sensor 15 measures the discharging temperature ("b" location) of refrigerant compressed in the compressor 110 and discharged through the outlet port 114. The discharging temperature sensor 15 may be located at a variety of locations to measure the discharging temperature of refrigerant discharged from the compressor 110. In this exemplary embodiment, the discharging temperature sensor 15 is provided at a "b" location.

Figure 3:
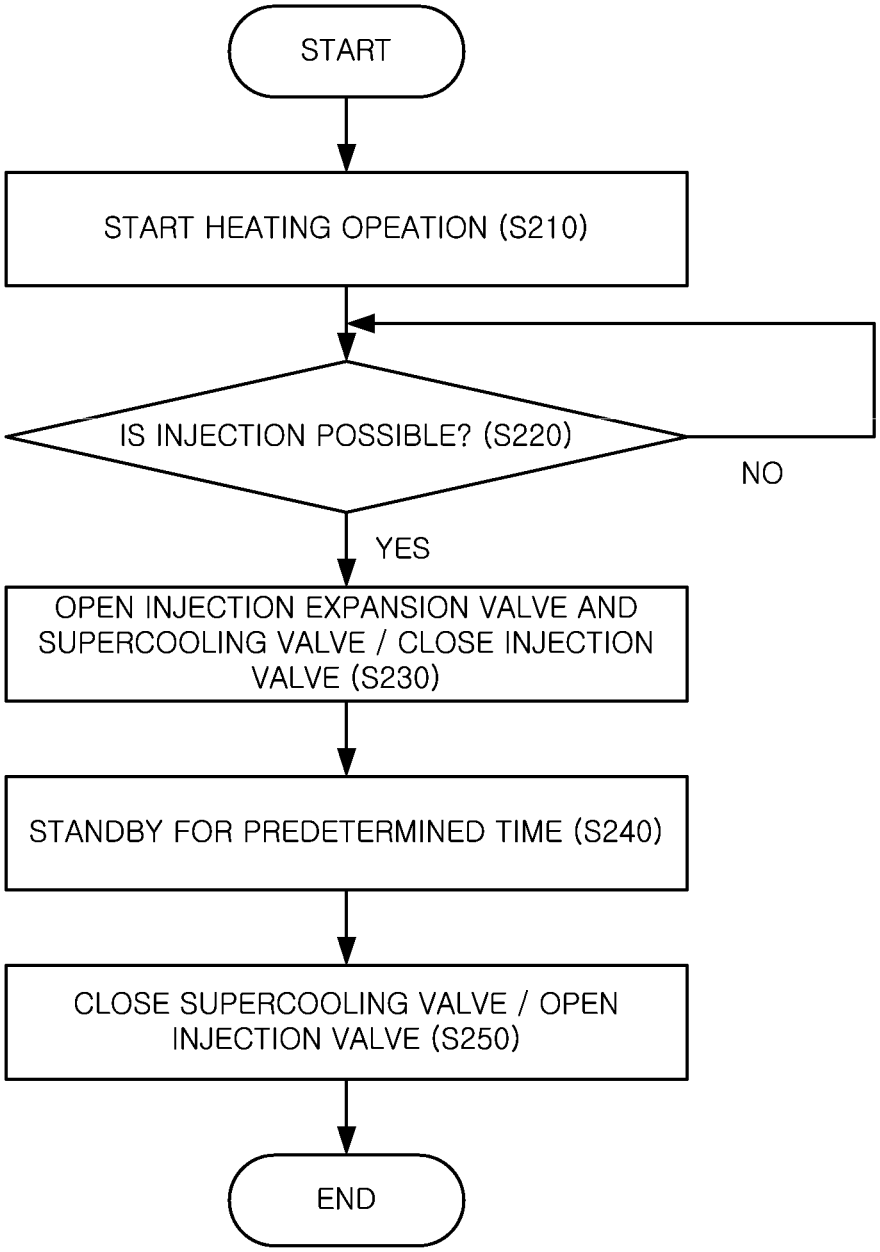
FIG. 3 is a flowchart of a method for controlling an air conditioner according to an exemplary embodiment of the present invention.
Figure 4:
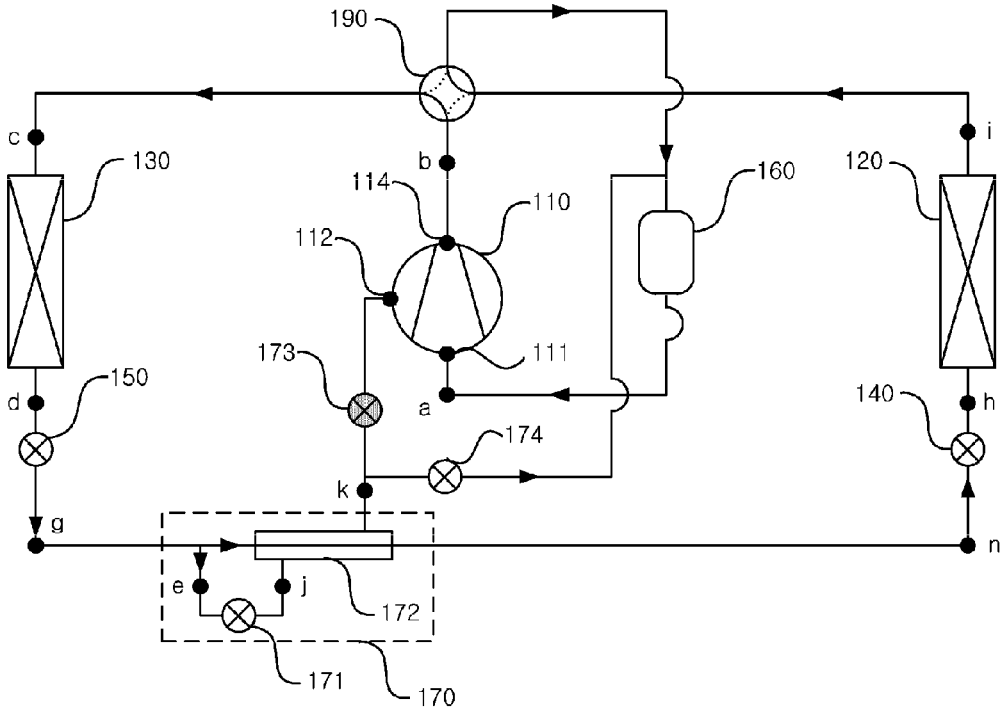
FIGS. 4 and 5 are schematic views illustrating a refrigerant flow in a heating operation of an air conditioner according to an exemplary embodiment of the present invention.
Figure 5:
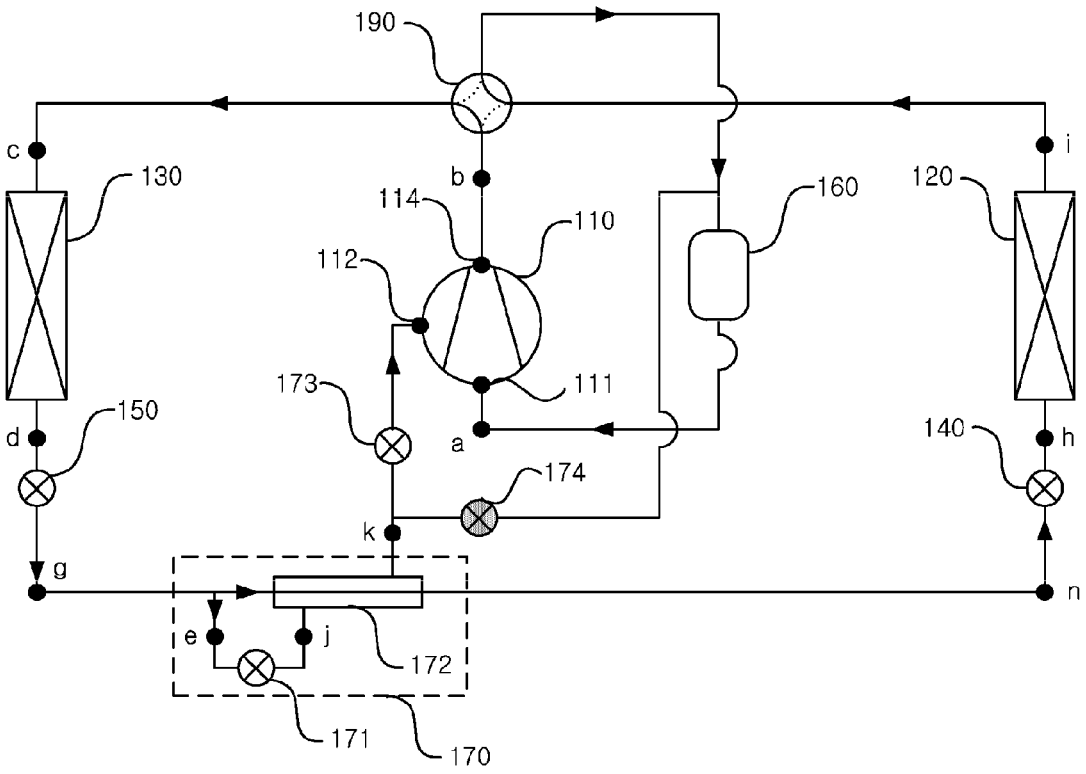

FIG. 3 is a flowchart of a method for controlling an air conditioner according to an exemplary embodiment of the present invention, and FIGS. 4 and 5 are schematic views illustrating refrigerant flow in a heating operation of an air conditioner according to an exemplary embodiment of the present invention.

The controller 10 starts the heating operation (S210). The controller 10 controls the converting unit 190 such that the outlet port 114 of the compressor 110 is connected to the indoor heat exchanger 130 and the outdoor heat exchanger 120 is connected to the accumulator 160. In addition, the controller 10 completely opens the outdoor expansion valve 140 and closes the injection expansion valve 171. Further, in accordance with the heating operation control logic, the controller 10 controls the operating speed of the compressor 110 and the opening degree of the expansion valve 150.

In addition, when the injection expansion valve 171 is in a closed status, the controller 10 maintains the injection expansion valve 171 closed. When the injection expansion valve 171 is in an opened status, the controller 10 closes the injection expansion valve 171.

The controller 10 determines whether or not it is possible for the injection module 170 to inject (S220). The controller 10 determines whether or not the injection condition is satisfied and thus, it is possible for the injection module 170 to inject refrigerant. The injection condition may be set based on the operating speed of the compressor 110, the discharge superheating degree, the condensing temperature, or the vaporizing temperature.

The operating speed of the compressor 110 is an RPM of a motor (not shown) generating torque for compressing refrigerant. The operating speed of the compressor 110 may be represented in a frequency unit. The operating speed of the compressor 110 is proportional to a compression capacity of the compressor 110. The controller 10 may determine whether or not the injection condition is satisfied by determining whether or not the operating speed of the compressor is higher than a predetermined operating speed.

The discharge superheating degree is a difference between the discharging temperature measured by the discharging temperature sensor 15 and the condensing temperature measured by the condensing temperature sensor 11. That is, (Discharge Superheating Degree)=(Discharging Temperature)−(Condensing Temperature). The controller 10 may determine whether or not the injection condition is satisfied by determining whether or not the discharge superheating degree is higher than a predetermined discharge superheating degree.

The condensing temperature is a condensing temperature of refrigerant measured by the condensing temperature sensor 11. In the heating operation, the condensing temperature is a temperature at which refrigerant is condensed in the indoor heat exchanger 130. The controller 10 may determine whether or not the injection condition is satisfied by determining whether or not the condensing temperature satisfies a predetermined condition.

The vaporizing temperature is a vaporizing temperature of refrigerant measured by the vaporizing temperature sensor 12. In the heating operation, the vaporizing temperature is a temperature at which refrigerant is vaporized in the outdoor heat exchanger 120. The controller 10 may determine whether or not the injection condition is satisfied by determining whether or not the vaporizing temperature meets a predetermined condition. The condensing and vaporizing temperatures may have a condition having a linear inequality relationship.

In one embodiment, the injection condition in the heating operation may be set to meet one or at least two of the operating speed of the compressor 110, the discharge superheating degree, the condensing temperature, and the vaporizing temperature.

When the injection condition is satisfied, the controller 10 opens the injection expansion valve 171 and the supercooling valve 174 and closes the injection valve 173 (S230). The controller 10 opens the injection expansion valve 171 that has been closed when starting the heating operation and adjusts the opening degree of the injection expansion valve 171 in accordance with the control logic.

When the injection valve 173 is in a closed status in the start of the heating operation, the controller 10 maintains the injection valve 173 closed. When the injection valve 173 is in a closed status, the controller 10 closes the injection valve 173.

When the supercooling valve 174 is in a closed status in the start of the heating operation, the controller 10 opens the supercooling valve 174. When the supercooling valve 174 is in an opened status, the controller 10 maintains the supercooling valve 174 opened.

The operation of the air conditioner when the injection condition is satisfied in the heating operation will be described hereinafter with reference to FIG. 4.

Refrigerant compressed in the compressor 110 is discharged through the outlet port 114 and directed to the converting unit 190. In the heating operation, the converting unit 190 connects the outlet port 114 of the compressor 110 to the indoor heat exchanger 130. Therefore, refrigerant directed to the converting unit 190 is transferred to the indoor heat exchanger 130.

Refrigerant transferred from the converting unit 190 to the indoor heat exchanger 130 heat-exchanges with the indoor air and is thus condensed. The condensed refrigerant is directed to the indoor expansion valve 150. In the heating operation, since the indoor expansion valve 150 is completely open, refrigerant passes through the indoor expansion valve 150 and is then directed to the injection module 170.

A portion of refrigerant coming from the indoor expansion valve 150 is directed to the injection expansion valve 171 and the rest is transferred to the injection heat exchanger 172.

Refrigerant transferred to the injection expansion valve 171 expands and is directed to the injection heat exchanger 172. Refrigerant directed to the injection heat exchanger 172 is vaporized by heat-exchanging with refrigerant flowing to the injection heat-exchange 172.

When the injection condition is satisfied, the injection valve 173 is closed and the supercooling valve 174 is open. Therefore, refrigerant vaporized in the injection heat exchanger 172 is directed to the accumulator 160 via the supercooling valve 174 and mixed with refrigerant vaporized in the indoor heat exchanger 130.

A portion of refrigerant coming from the indoor expansion valve 150 is supercooled by heat-exchanging with refrigerant expanding by the injection expansion valve 171 in the injection heat exchanger 172. The supercooled refrigerant is directed to the outdoor expansion valve 140. Refrigerant directed to the outdoor expansion valve 140 expands and is then directed to the outdoor heat exchanger 120 and vaporized by heat-exchanging with the outdoor air. The vaporized refrigerant is transferred to the converting unit 190.

The converting unit 190 connects, in the heating operation, the outdoor heat exchanger 120 to the accumulator 160. Therefore, refrigerant directed from the outdoor heat exchanger 120 to the converting unit 190 is transferred to the accumulator 160. Refrigerant transferred to the accumulator 160 is mixed with refrigerant coming from the supercooling valve 174 and the gas-phase and liquid-phase refrigerants are separated from the mixed refrigerant. The gas-phase refrigerant separated in the accumulator 160 is introduced into the compressor 110 through the inlet port 111 and compressed in the compressor 110, after which refrigerant is discharged through the outlet port 114.

The controller 10 opens the supercooling valve 174 and maintains the injection valve 173 closed (S240). The controller 10 opens the supercooling valve 174 and maintains the injection valve 173 closed for a predetermined time so that the oil and condensed refrigerant remaining in the injection module 170 can be directed to the accumulator 160. That is, the predetermined time is a standby time for sufficiently discharging the oil and condensed refrigerant remaining in the injection module 170.

The controller 10 closes the supercooling valve 174 after the predetermined time passes and opens the injection valve 173 (S250).

The operation of the air conditioner when the injection condition is satisfied and the predetermined time passes will be described hereinafter with reference to FIG. 5.

Refrigerant compressed in the compressor 110 is directed to the converting unit 190. In the heating operation, the converting unit 190 connects the outlet port 114 of the compressor 110 and the indoor heat exchanger 130. Therefore, refrigerant directed to the converting unit 190 is transferred to the indoor heat exchanger 130.

Refrigerant directed from the converting unit 190 to the indoor heat exchanger 130 is condensed by heat-exchanging with the indoor air. The condensed refrigerant is transferred to the indoor expansion valve 150. In the heating operation, the indoor expansion valve 150 is fully opened and thus, refrigerant is directed to the injection module 170.

A portion of refrigerant coming from the indoor expansion valve 150 is directed to the injection expansion valve 171 and the rest is again directed to the injection heat exchanger 172.

Refrigerant directed to the injection expansion valve 171 expands and is then directed to the injection heat exchanger 172. Refrigerant expanding in the injection expansion valve 171 is transferred to the injection heat exchanger 172 and vaporized by heat-exchanging with refrigerant flowing from the indoor expansion valve 150 to the injection heat exchanger 172.

After a predetermined time passes, the injection valve 173 is opened and the supercooling valve 174 is closed. Therefore, refrigerant vaporized in the injection heat exchanger 172 is transferred to the injection valve 173. Refrigerant passing through the injection valve 173 is directed to the compressor 110 through the injection port 112 and compressed by the compressor, after which refrigerant is discharged through the outlet port 114.

A portion of refrigerant coming from the indoor expansion valve 150 is supercooled by heat-exchanging with refrigerant that expands by the injection expansion valve 171 in the injection heat exchanger 172. The supercooled refrigerant is directed to the outdoor expansion valve 140 and expands, after which it is directed to the outdoor heat exchanger 120. Refrigerant directed to the outdoor heat exchanger 120 is vaporized by heat-exchanging with the outdoor air. The vaporized refrigerant is transferred to the converting unit 190.

Since the converting unit 190 connects the outdoor heat exchanger 120 to the accumulator 160 in the heating operation, refrigerant directed from the outdoor heat exchanger 120 to the converting unit 190 is directed to the accumulator 160 and mixed with refrigerant directed from the supercooling valve 174, after which the gas-phase and liquid-phase refrigerants are separated from the mixed refrigerant. The gas-phase refrigerant separated in the accumulator 160 is introduced into the compressor 110 through the inlet port 111 and compressed by the compressor 110, after which it is discharged through the outlet port 114.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description but by the appended claims, and all differences within the scope will be construed as being included in the claims.

According to the air conditioner and the method for controlling the air conditioner may have at least one of the following effects.

First, since the oil and condensed refrigerant remaining in the injection module in the initial stage of the heating operation are not injected into the compressor, the reliability of the compressor can be improved.

Second, in the initial stage of the heating operation, only the vaporized refrigerant is injected by opening the supercooling valve disposed between the injection module and the accumulator, closing the supercooling valve after a predetermined time passes, and opening the injection valve disposed between the injection module and the inlet port of the compressor.

The effects of the present invention are not limited to the above; other effects that are not described herein will be clearly understood by the persons skilled in the art from the following claims.

What is claimed is:

1. An air conditioner comprising:

a compressor to compress refrigerant;

an outdoor heat exchanger to be disposed outdoors to allow the refrigerant to heat-exchange with outdoor air; an indoor heat exchanger to be disposed indoors to allow the refrigerant to heat-exchange with indoor air;

a converting unit to direct the refrigerant discharged from the compressor to the outdoor heat exchanger in a cooling operation and to the indoor heat exchanger in a heating operation; an accumulator disposed between the converting unit and the compressor to separate gas-phase and liquid phase refrigerants;

an injection module to expand and to vaporize a portion of refrigerant flowing from the indoor heat exchanger to the outdoor heat exchanger in the heating operation; a controller;

a supercooling valve disposed between the injection module and the accumulator; and an injection valve disposed between the injection module and the compressor, wherein the injection module comprises:

an injection expansion valve to expand the portion of refrigerant flowing therethrough; and an injection heat exchanger to supercool the rest of refrigerant by allowing the rest of refrigerant to heat-exchange with the portion of the refrigerant expanded by the injection expansion valve, wherein the controller is configured to:

control the converting unit to direct the refrigerant discharged from the compressor to the indoor heat exchanger at a start of the heating operation, wherein the injection expansion valve, the supercooling valve and the injection valve are closed, open the supercooling valve and the injection expansion valve in a closed state of the injection valve to direct oil and condensed refrigerant remaining in the injection module to an accumulator through the supercooling valve, determine whether a predetermined time for discharging the oil and condensed refrigerant remaining in the injection module had passed, close the supercooling valve when the controller determines that the predetermined time had passed, and open the injection valve to direct the portion of the refrigerant vaporized by the injection module to the compressor through the injection valve.

2. The air conditioner of claim 1, wherein the controller opens the supercooling valve and the injection expansion valve when the controller determines that an injection condition is satisfied in the heating operation.

3. The air conditioner of claim 2, wherein the controller determines whether the injection condition is satisfied by determining at least one of a discharge superheating degree that is a difference between a discharging temperature of the refrigerant of the compressor and a condensing temperature of the refrigerant in the indoor heat exchanger, a condensing temperature of the refrigerant in the indoor heat exchanger, a vaporizing temperature of the refrigerant in the outdoor heat exchanger, and an operating speed of the compressor.

4. The air conditioner of claim 3, wherein the controller determines that the injection condition is satisfied when the discharge superheating degree is higher than a predetermined discharge superheating degree.

5. The air conditioner of claim 3, wherein the controller determines that the injection condition is satisfied when the operating speed of the compressor is higher than a predetermined operating speed.

6. The air conditioner of claim 1, wherein the predetermined time is time to allow oil and condensed refrigerant remaining in the injection module to discharge to the accumulator.

7. A method of controlling an air conditioner comprising:

directing, by a converting unit, refrigerant discharged from a compressor to an indoor heat exchanger at a start of the heating operation, wherein an injection expansion valve, a supercooling valve and an injection valve are closed;

opening the supercooling valve and the injection expansion valve by a controller in a closed state of the injection valve to direct oil and condensed refrigerant remaining in an injection module to an accumulator through the supercooling valve;

determining by the controller whether a predetermined time for discharging the oil and condensed refrigerant remaining in the injection module had passed;

closing the supercooling valve by the controller when the controller determines that the predetermined time had passed; and opening the injection valve by the controller to direct a portion of the refrigerant vaporized by the injection module to the compressor through the injection valve.

8. The method of claim 7, wherein the controller opens the supercooling valve and the injection expansion valve when the controller determines that an injection condition is satisfied.

9. The method of claim 8, wherein the controller determines whether the injection condition is satisfied by determining at least one of a discharge superheating degree that is a difference between a discharging temperature of refrigerant of the compressor and a condensing temperature of refrigerant in the indoor heat exchanger, a condensing temperature of the refrigerant in the indoor heat exchanger, a vaporizing temperature of the refrigerant in the outdoor heat exchanger, and an operating speed of the compressor.

10. The method of claim 9, wherein the controller determines that the injection condition is satisfied when the discharge superheating degree is higher than a predetermined discharge superheating degree.

11. The method of claim 9, wherein the controller determines that the injection condition is satisfied when the operating speed of the compressor is higher than a predetermined operating speed.

12. The method of claim 7, wherein the predetermined time is time to allow oil and condensed refrigerant remaining in the injection module to discharge to the accumulator.

* * * * *